US008051596B1

(12) United States Patent
Thomas, Jr.

(10) Patent No.: US 8,051,596 B1
(45) Date of Patent: Nov. 8, 2011

(54) HANDS-FREE FIREARM STABILIZER

(76) Inventor: James G. Thomas, Jr., Bowling Green, KY (US)

( * ) Notice: Subject to any disclaimer, the term of this patent is extended or adjusted under 35 U.S.C. 154(b) by 338 days.

(21) Appl. No.: 12/268,826

(22) Filed: Nov. 11, 2008

(51) Int. Cl.
*F41C 27/00* (2006.01)

(52) U.S. Cl. ..... 42/94; 42/85; 42/71.01; 42/73; 24/2.5; 224/150

(58) Field of Classification Search ..... 42/94, 85, 42/71.01, 73; 24/2.5; 224/150
See application file for complete search history.

(56) References Cited

U.S. PATENT DOCUMENTS

| | | | | | |
|---|---|---|---|---|---|
| 476,246 | A | * | 6/1892 | Burgess | 42/21 |
| 1,357,232 | A | * | 11/1920 | Green | 42/73 |
| 2,296,733 | A | * | 9/1942 | Paolino | 224/150 |
| 2,401,903 | A | * | 6/1946 | Browning | 42/16 |
| 2,913,960 | A | * | 11/1959 | Harvey et al. | 89/1.815 |
| 2,970,398 | A | * | 2/1961 | Crouch | 42/69.01 |
| 3,081,923 | A | * | 3/1963 | Bagby | 224/149 |
| 3,324,588 | A | * | 6/1967 | Gilbert | 42/71.01 |
| 3,430,828 | A | * | 3/1969 | Gregson | 224/149 |
| 3,442,042 | A | * | 5/1969 | Van Tyle | 42/73 |
| 3,606,109 | A | * | 9/1971 | Brokus | 224/149 |
| 3,665,632 | A | * | 5/1972 | Ford | 42/71.01 |
| 3,875,694 | A | * | 4/1975 | Wild | 42/73 |
| 4,296,566 | A | * | 10/1981 | Campos | 42/71.01 |
| 4,515,301 | A | * | 5/1985 | A'Costa | 224/637 |
| 4,575,964 | A | | 3/1986 | Griffin | |
| 4,790,095 | A | * | 12/1988 | Campos | 42/73 |
| 5,180,874 | A | * | 1/1993 | Troncoso, Jr. | 42/72 |
| 5,325,618 | A | * | 7/1994 | Turner | 42/85 |
| 5,575,411 | A | | 11/1996 | Hightower | |
| 5,687,422 | A | | 11/1997 | Wurst et al. | |
| 5,810,219 | A | | 9/1998 | Rosenfield | |
| 6,325,258 | B1 | | 12/2001 | Verdugo et al. | |
| 6,520,390 | B2 | | 2/2003 | Verdugo et al. | |
| 7,028,427 | B2 | * | 4/2006 | Crawford | 42/72 |
| 7,059,502 | B2 | | 6/2006 | Johnson | |
| 7,506,470 | B2 | * | 3/2009 | Pereksta | 42/94 |
| 2002/0036219 | A1 | | 3/2002 | Neighbors | |
| 2008/0086928 | A1 | * | 4/2008 | Pereksta | 42/94 |

* cited by examiner

*Primary Examiner* — Michelle Clement
(74) *Attorney, Agent, or Firm* — Laura M. Hagan; Kerrick, Stivers, Coyle

(57) ABSTRACT

A hands-free firearm stabilizer device comprising a means for securing a firearm to perpendicularly to the shoulder of a hunter. The fully adjustable device can be adjusted to accommodate any gunstock and hunter, allowing the hunter to wait for game in a relaxed hands-free position or utilize game calls without sacrificing firearm stability. Additionally, hunters can position themselves in a seated position allowing fine aiming adjustments using his/her knee preventing unwanted noise and movement that could be detected by the game and providing a viable option for hunters with disabilities that may limit their ability participate in the sport of hunting.

7 Claims, 3 Drawing Sheets

HANDS-FREE FIREARM STABILIZER

BACKGROUND OF THE INVENTION

In hunting, the simplest way to ensure the hunter an opportunity to shoot a target is maintaining a motionless position while keeping the rifle in a ready to fire position. Due to the length of time a hunter may be in the field waiting for a target, an additional concern is fatigue and gun stability that can affect the safety of the hunter. In prior art, hands-free mechanisms have attempted to address this issue by creating attachable slings and strap systems that are not easily removable or do not provide adequate stability to the butt of the gun to prevent the gun from slipping.

It is known by those skilled in the art that the visual acuity of most wild game, especially turkeys, is such that small positional changes by the hunter can startle the game being hunted. With the time and patience necessary to be an effective hunter, having an open shot only to alert the game to your presence can be a frustrating reality.

The positioning of the gun in prior art does not fully eliminate the need to further lift the gun to sight a target, which does not fully address the motionless aspects hoped to be achieved. The complicated strap and attachment systems can become cumbersome and potentially belie the safety of the hunter should an event occur that would require the system to be removed quickly. Other concerns in the current state of the art pertain to hunters that suffer from disabilities that prevent them from using prior inventions effectively.

SUMMARY OF THE INVENTION

The present invention fulfills a much needed improvement of the prior art, comprising a means for stabilizing a firearm in a ready to fire position while allowing the hunter's hands to remain free. The advantageous embodiment of the current invention allows the firearm to not only be stabilized about the gunstock but to be held in a position in which aiming requires minimal movement by the hunter. This hands-free feature allows the hunter to utilize game calls without sacrificing firearm stability or game call quality while easily returning to a sighting position with minimal movement.

Disabilities affecting the fine motor skills of the hands can prohibit avid hunters from continuing in the sport. The present invention can be easily used in the field by a hunter with such disabilities allowing those individuals the opportunity to safely reclaim a sport to which they were previously devoted. Additionally, the one maneuver release of the current invention allows for quick detachment of the device and adjoined firearm when not in use, further addressing safety and ease of use, as compared to prior art.

DETAILED DESCRIPTION OF THE INVENTION

Figure 1:
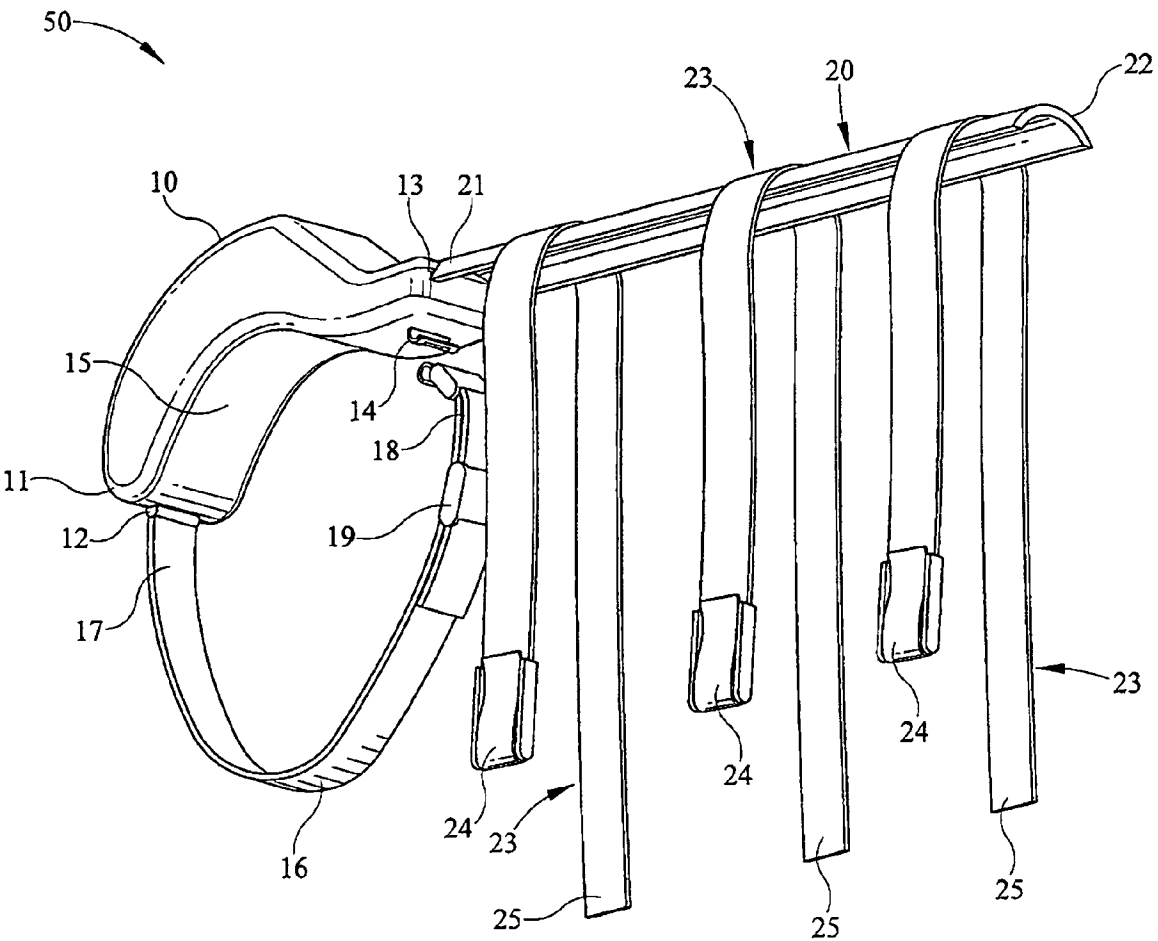
FIG. 1 is a perspective view of the invention when detached from the firearm, including an alternative embodiment of the underarm strap as a wider structure for greater durability.

In the following description, numerous specific details and options of the present invention are set forth in order to provide a more thorough understanding of the claimed invention. It will be appreciated, by one skilled in the art that the Hands-Free Long Gun Stabilizer of the present disclosure may be practiced without such specific details or optional components and that such description are merely for convenience and as such solely selected for the purpose of illustrating the invention. Reference to the figures showing embodiments of the present invention are made to describe the invention and do not limit the scope of the disclosure herein.

The Hands-free Firearm Stabilizer 50 is essentially comprised of a curved component 10, a rear connection point 12, a detachable connection point 14, a shoulder securing means 16 and a gunstock securing means 20.

Figure 3:
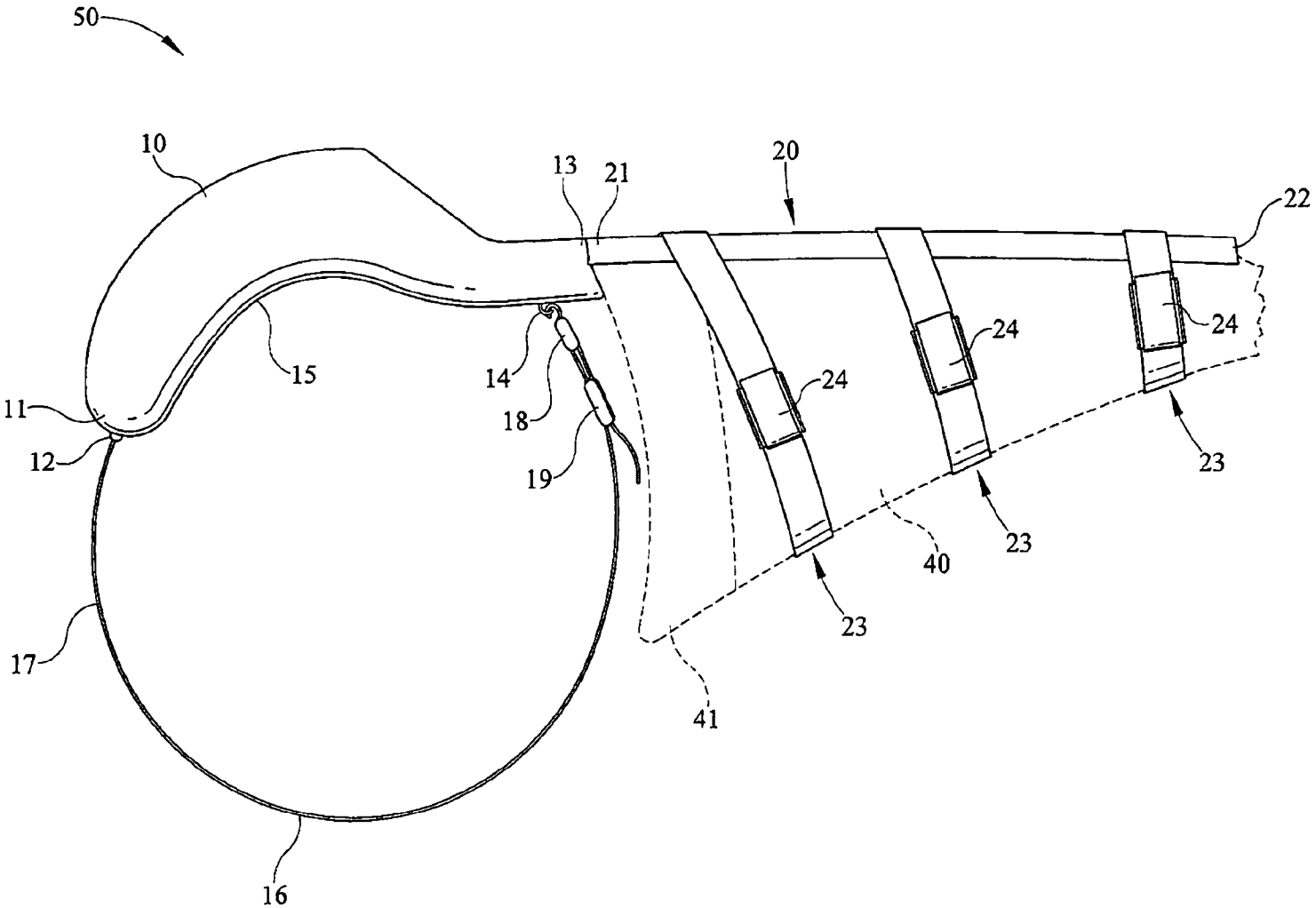
FIG. 3 is a perspective view of the invention as attached to the butt of the firearm, also shown are the tightening aspects of all of the straps on both the firearm and the shoulder securing means.

The curved component 10 constructed of metal, wood, polymer or equivalent substances, comprises a rearward end 11, a forward end 13 and a shoulder arc 15 as shown in FIG. 1. The shoulder arc 15, being an essentially laterally concave indentation, and of sufficient size to accommodate a hunter's shoulder. A shoulder securing means 16, having a first terminating end 17 and a second terminating end 18, is connected to the rear connection point 12 by adhesives, screws or equivalent attachment means about the first terminating end 17 and to the detachable connection point 14 by a hook and eye assembly, or equivalent detachable connection means, at the second terminating end 18, as shown in FIG. 1 and FIG. 3. It should also be understood by one skilled in the art that the rear connection point 12 can be detachable to allow the shoulder securing means 16 to be removed or exchanged. A sliding adjustment means 19, disposed on the shoulder securing means 16, is readily accessible to the hunter and can be used to tighten or loosen the shoulder securing means 16, allowing the invention to be easily used by hunters of a variety of builds. The sliding adjustment means 19 can be constructed with plastic, metal or equivalent adjustment and clamping means known in the art.

A gunstock securing means 20 having a first end 21 and a second end 22 is perpendicularly affixed at the first end 21 to the forward end 13 of the curved component 10 via a screw, permanent weld, adhesives or similar means. The gunstock securing means 20 being a concave projection of sufficient width and length to accommodate the convex comb of a standard gunstock 40 and maintain the firearm in an essentially perpendicular position relative to the hunter. In an alternative embodiment, the curved component 10 and the gunstock connection means 20 could be detachable, allowing the hunter to detach the firearm from his/her shoulder without releasing the shoulder securing means 16.

Figure 2:
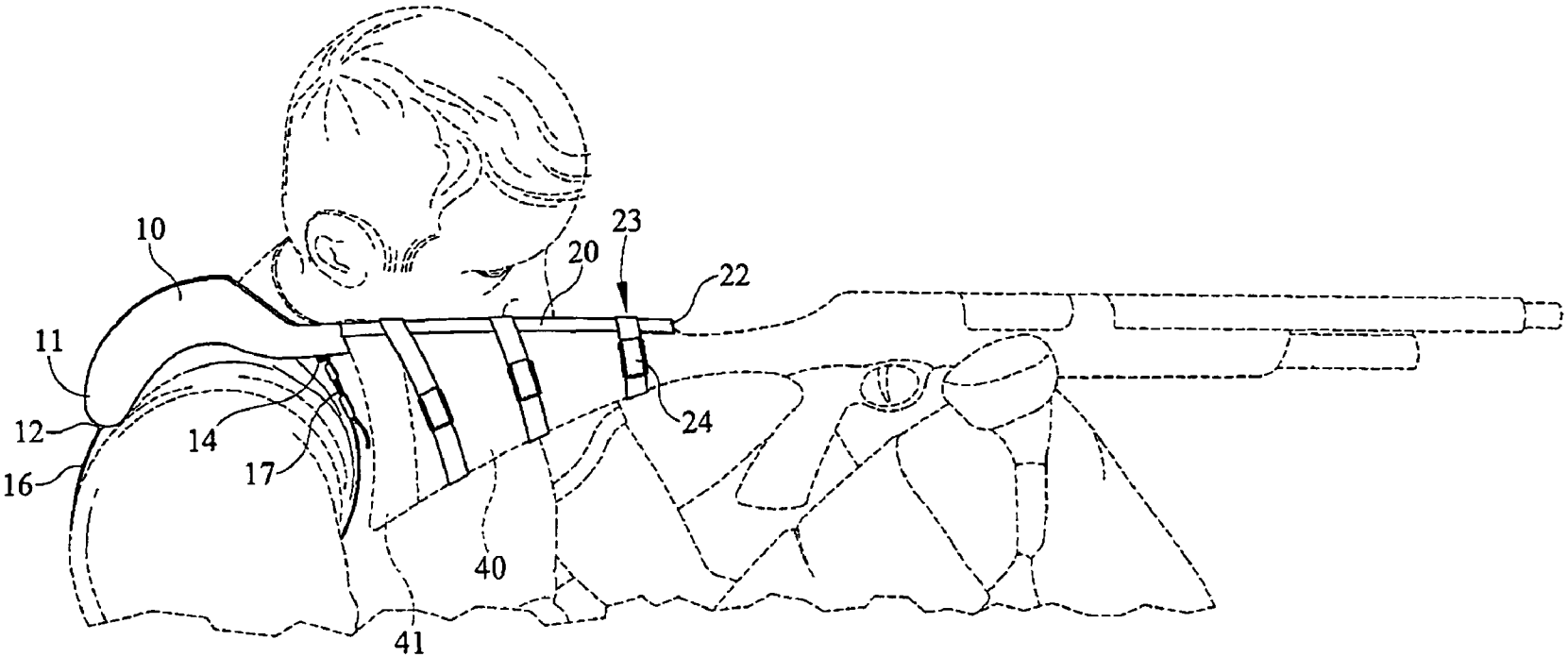
FIG. 2 is a perspective view of the invention as used by the hunter demonstrating the aiming capabilities of the hunter while in a seated position and using known sporting equipment to hold the barrel of the gun level.

As demonstrated in FIG. 1, the thickness of the gunstock securing means 20 is substantially less that that of the forward end 13 of the curved component 10. When affixed to a standard gunstock 40, the forward end 13 is adjacent to the butt 41 of the gunstock 40 preventing movement of the firearm within the concave channel of the gunstock securing means 20 beyond the abutting forward end 13, as shown in FIG. 2. A plurality of adjustable attachment means 23 having a clamping means end 24 and an adjustment end 25 are made with nylon or equivalent material and perpendicularly affixed between the first end 21 and the second end 22 with adhesive, rivets or equivalent attachment means. The clamping means end 24 consists of a means for clamping or locking the adjustment end 25 in the desired position in which the gunstock 40 is securely held in place, within the gunstock securing means 20.

As attached, the invention 50 can additionally stabilized with the hunter's knee or additional stabilizing equipment such as kneepads currently known in the art, as demonstrated in FIG. 2. Also shown in FIG. 2, the hunter's line of sight can easily adjust to meet the sights of the firearm with minimal head movement, allowing the firearm to maintain a steady position throughout the sighting and firing process, and concealing necessary movements behind the bent legs of the hunter. For inexperienced hunters or those with disabilities the current invention will allow the hunter to aim and steady the firearm while maintaining the firearm stability during recoil.

The invention claimed is:

1. A firearm stabilizing device comprising:

a curved component having a rearward end, a forward end and a shoulder are;

a rear connection point disposed on the rearward end whereby a first terminating end of a shoulder securing strap is affixed to the rearward end of the curved component;

a releasable detachable connection point affixed on the forward end of the curved component whereby a second terminating end of the shoulder securing strap is affixed to the forward end of the curved component;

a concave projection having a first end and a second end directly affixed to the forward end of the curved component.

2. A firearm stabilizing device of claim 1 wherein the shoulder arc creates a lateral concave channel.

3. A firearm stabilizing device of claim 1 wherein the shoulder securing strap further has an adjustment device.

4. A firearm stabilizing device of claim 1 wherein the said rear connection point is releasable.

5. A firearm stabilizing device of claim 1 wherein the first end of the concave projection is releasable from the forward end of the curved component.

6. A firearm stabilizing device of claim 1 wherein a plurality of adjustable attachment straps, having a clamping end and a free end are affixed to the concave projection.

7. A firearm stabilizing device of claim 6 wherein the clamping end of the attachment straps will adjust and secure the free end of the attachment strap.

* * * * *